United States Patent [19]

Waldron

[11] 4,304,286

[45] Dec. 8, 1981

[54] MAKING MOULDS

[75] Inventor: Stephen N. Waldron, Wetherby, England

[73] Assignee: Boc Limited, London, England

[21] Appl. No.: 129,923

[22] Filed: Mar. 13, 1980

Related U.S. Application Data

[63] Continuation of Ser. No. 959,409, Nov. 9, 1978, abandoned.

[30] Foreign Application Priority Data

May 26, 1978 [GB] United Kingdom ..... 41898/78
Oct. 25, 1978 [GB] United Kingdom ..... 23615/78

[51] Int. Cl.[3] ..... B22C 1/22
[52] U.S. Cl. ..... 164/4.1; 164/154; 164/159; 164/526
[58] Field of Search ..... 164/4, 12, 16, 43, 154, 164/159; 260/DIG. 40

[56] References Cited

U.S. PATENT DOCUMENTS

| | | | |
|---|---|---|---|
| 3,472,307 | 10/1969 | Godding | 164/43 X |
| 3,919,162 | 11/1975 | Austin | 164/12 X |
| 3,947,420 | 3/1976 | Bardet | 164/43 X |
| 4,150,704 | 4/1979 | Hoult | 164/12 |

*Primary Examiner*—Robert D. Baldwin
*Assistant Examiner*—J. Reed Batten, Jr.
*Attorney, Agent, or Firm*—David L. Rae; Larry R. Cassett

[57] ABSTRACT

In the manufacture of moulds or mould cores, refractory sand, a resin binder and a catalyst are passed into a mixer to form a free-flowing mixture from which the moulds or mould cores are made. As the sand is fed into the mixer it is cooled by contact with an atmospheric gas in liquid or solid state or the cold vapor of such a gas so as to keep the temperature of the sand as it enters the mixer below that at which the resin cures. To enable the sand to be delivered below a chosen temperature from a quarry to a foundry where the sand is used, the sand after quarrying and drying is fluidized by air, an atmospheric gas in liquid or solid state being introduced into the fluidizing air so as to lower its temperature.

9 Claims, 5 Drawing Figures

MAKING MOULDS

This is a continuation of application Ser. No. 959,409, filed Nov. 9, 1978 and now abandoned.

BACKGROUND OF THE INVENTION

1. Field of the Invention

This invention relates to a method of making moulds, and mould cores from refractory sand. The moulds or mould-parts may be used in a foundry to make castings of ferrous or non-ferrous metal. The invention also relates to a method of cooling sand.

2. Description of the Prior Art

There are two main types of refractory composition from which parts of moulds are made. One type, generally referred to as green sand, employs refractory sand, starch, water and a carbonaceous material such as coal dust. The other type of composition is characterised in that in addition to refractory sand, a resin binder is employed. The resin is generally of the thermosetting type. With such compositions including a resin binder, the necessary ingredients are fed into a mixer and mould parts are then formed from the resulting mixture. The process of forming the parts of the mould requires the binder to be cured. Generally, a catalyst is mixed with the sand and the binder to accelerate curing.

The problem arises, particularly in hot weather, that the curing process can start in the mixer with the consequence that by the time the mixture enters the moulding station it is no longer free-flowing and is thus unusable so far as the making of mould parts is concerned.

Although a hot environment in the foundry is typically a cause of the sand mixture entering the moulding station at too high a temperature, sometimes the sand itself may be supplied to the foundry at too high a temperature.

It is important to avoid premature setting of the resin. To this end foundries commonly specify that the sand must be supplied at below a chosen maximum temperature, typically in the order of 26° C.

The sand is obtained by quarrying. Since the sand so obtained is wet it is necessary to heat the sand so as to dry it. Typically, this is done by fluidising the sand with hot air. This raises the temperature of the sand. It is thus necessary to cool it. This is conventionally done by means of a fluidised bed cooling technique. The warm sand is fed into a chamber and fluidised by ambient air. This enables intimate contact to take place between each grain of sand and the air. Sometimes the cooling effect of the air is supplemented by passing water through heat exchange tubes within the bed. Since the air is at ambient temperature, the sand will effectively be cooled to below the chosen temperature in all but hot summer weather unless a longer period of heating than usual is required to dry the sand, thereby increasing the temperature of the sand to above that at which it normally enters the fluidised bed. Once the sand has been cooled it is passed into a large storage hopper. From time to time regular deliveries of the sand from the storage hopper are made to foundries in a suitable vehicle. The thermal insulation properties of sand are such that a hot batch of sand (ie. a batch of sand above the chosen temperature) will remain at that temperature for long periods. Thus, when such a batch of sand reaches the bottom of the hopper it will still be at an undesirably high temperature and will be delivered at that temperature to the foundry.

OBJECTS OF THE INVENTION

It is an object of the invention to provide a method of cooling the sand in the foundry to a temperature at which premature curing of the resin is prevented.

It is another object of the invention to provide a method of cooling sand on-site at a quarry which enables the temperature of the sand to be kept at or below a chosen temperature.

SUMMARY OF THE INVENTION

According to one aspect of the invention there is provided a method of making moulds or mould cores, which comprises passing refractory sand, a resin binder and a catalyst into a mixer to form a free-flowing mixture thereof, and forming moulds or mould cores from the mixture, in which method sand as it is moving from a vessel into the mixer is cooled by contact with an atmospheric gas in liquid or solid state or the cold vapour of such a gas so as to keep the temperature of the sand as it enters the mixer below that at which curing of the resin takes place.

The invention also provides apparatus for making parts of moulds, comprising vessels for containing refractory sand, resin binder and catalyst, passages placing the vessels in communication with a mixer, a moulding station in communication with the mixer, and means for introducing an atmospheric gas in liquid or solid state or cold vapour of such a gas into the passage placing the vessel for refractory sand in communication with the mixer.

According to another aspect of the invention there is provided a method of obtaining cooled sand, comprising the steps of quarrying the sand, drying it, fluidising the dried sand with air taken from the atmosphere, and reducing the temperature of the said air by heat exchanging or mixing it with an atmospheric gas in liquid or solid state, or the cold vapour of such gas.

Preferably, the atmospheric gas is a cryogenic liquid, (ie. a liquefied gas having a boiling point below minus 100° C. at atmospheric pressure). The cryogenic liquid is preferably liquid nitrogen. Alternatively, liquid or solid carbon dioxide may be used.

The sand may be any one of the types conventionally used, eg. silica sand, zircon sand, chromite sand or olivine sand.

A hot-box or cold-box process may, for example, be used to form the moulds or mould cores.

For the hot box process, the binder may typically be a thermosetting furane or phenol-formaldehyde resin. The catalyst may for example be an acid salt such as ammonium chloride or ferric chloride which decomposes on heating to yield hydrogen chloride.

Typical binders for the cold box process include furane resins which are used with acid catalysts such as phosphoric acid and para-toluene sulphonic acid; phenol-formaldehyde resol resin which is catalysed by a strong acid such as para-toluene sulphonic acid; alkyd oil-isocyanate systems (for example alkyd oil and methylene diphenyl diisocyanate) which use metal naphthenates or dibutyl tin dilanate as catalyst, and phenolic-isocyanate systems which are catalysed by triethylamine or dimethylethylamine.

Hot box binder-catalyst systems, in particular, tend to start to cure at temperatures appreciably below 50° C. This is particularly true of urea-furfuryl alcohol and phenol-furfuryl alcohol resins.

In the mould making method and apparatus the cryogenic liquid (or solid carbon dioxide) is preferably sprayed at the sand as it passes to the mixer. Typically, the sand will be allowed to fall under gravity from a hopper into a generally vertical passage which terminates in an inlet to the mixer. The cryogenic liquid can thus conveniently be sprayed at the sand as it is falling under gravity. This is a far more effective way of reducing the temperature of the sand than is cooling a stationary body of the sand. Preferably there are a number of spray heads each adapted to receive cryogenic liquid from an annular pipe in communication with a source of liquid nitrogen. The annular pipe will typically be generally horizontally disposed. The spray heads will conveniently be adapted to direct sprays of cryogenic liquid radially inwards at sand falling through the annulus defined by the pipe.

In the mould making method and apparatus, there will typically be a main pipe connecting the annular pipe or other means for placing the spray heads or outlets in communication with the source of cryogenic liquid. The flow of cryogenic liquid to the spray heads or outlets is preferably controlled by a valve, which will typically be disposed in the aforesaid main pipe. Preferably, there is a temperature sensor situated in the passage or the outlet of the hopper (or other vessel) upstream of where the cryogenic liquid is introduced into the passage. Introduction of cryogenic liquid is preferably initiated only when the sensed temperature rises above a chosen value. If desired, this introduction may be effected automatically. The sensor may generate an electrical or other signal to be received by a controller which is operatively associated with the valve (which is typically a solenoid valve). The controller is preferably programmed to adjust the setting of the solenoid valve according to the sensed temperature. If desired, there may be another temperature sensor operatively associated with the controller and located at or near to the inlet (for sand) to the mixer. This sensor may be arranged to actuate means for increasing the rate of introduction of cryogenic liquid should this other temperature sensor indicate that the temperature of the sand is above a chosen temperature. Typically, there may be two main cryogenic liquid supply pipes, each having a solenoid valve disposed therein, one solenoid valve being associated with one sensor and the other solenoid valve being associated with another sensor.

The temperature at which the sand enters the mixer of the mould making apparatus is desirably carefully controlled. Preferably, it is kept within plus or minus 4° C. of a chosen temperature. The temperature at which it is desirable to maintain the sand entering the mixer will depend on the particular resin binder-catalyst system to be used. Thus no universal generalisation can be made as to how great this temperature should be. However, the optimum temperature can readily be selected by simple experiment. It will need to be sufficiently low to prevent a significant amount of curing of the resin taking place in the mixer. However, if the temperature of the sand entering the mixer is too far below that at which a significant amount of reaction takes place in the mixer, the consequence will generally be that for a given rate of input of heat at the moulding station the rate of curing and hence of forming moulds will be undesirably slow. Thus, the temperature of the sand entering the mixer is preferably controlled at only a few degrees Centrigrade below that at which the rate of reaction in the mixer becomes significant. For many systems we believe that this temperature will be close to a value in the range 20° C. to 30° C. (Typically, the temperature will be kept below 27° C.).

Preferably, in the mould making apparatus, there is associated with the passage into which cryogenic liquid (or its cold vapour) is introduced means for extracting the vapour after it has given up at least some of its cold to the sand. Typically, a fan may have its inlet in communication with the passage so as to effect extraction of the vapour. If desired, the inlet passage to the fan may have disposed therein a screen effective to prevent sand particles being carried over into the fan. If the vapour extracted by the fan or other means is sufficiently below ambient temperature it may be used to cool sand kept in a main or bulk storage hopper which is used to store sand before it is passed into the hopper or other vessel associated with the mixer. Typically such bulk hoppers have associated therewith cooling coils through which a coolant such as water is passed. The vapour may be used to reduce the temperature of the coolant.

The method and apparatus according to the invention make it possible to control the temperature of the sand entering the mixer in hot climatic conditions.

In a method of obtaining cooled sand according to the invention liquid nitrogen may be sprayed or otherwise introduced into the fluidised bed. Instead of liquid nitrogen it is possible to use other liquefied atmospheric gases, for example, liquid argon or liquid carbon dioxide. It is also possible in the example of carbon dioxide to blow carbon dioxide snow, or other form of solid carbon dioxide, into the fluidised bed.

Other less preferred cooling methods involve heat exchanging the fluidising air with a liquefied atmospheric gas upstream of the fluidised bed. If desired, the vaporised gas may afterwards be mixed with the fluidising air. It is also possible to introduce cold vaporised gas into the fluidising air after having vaporised the liquefied gas by heat exchange with a medium other than the fluidising air. This is not preferred, however, as it is wasteful of the latent heat of vaporisation of the gas.

A preferred method of cooling is to introduce the liquid nitrogen or liquid carbon dioxide directly into the fluidising air upstream of the fluidising bed.

However the cooling is performed, it will not generally be necessary to introduce the liquidfied gas, solid gas or cold vapour continuously. Typically, the liquefied atmospheric gas will be supplied through a pipeline. In the pipeline a valve is preferably disposed. The valve is preferably of an automatic kind. Desirably, there is at least one temperature sensor located in the bed (or its outlet) when fluidised. The arrangement is typically such that the valve will only be opened when the sensed temperature is at or above a chosen value. Once the temperature falls below the chosen value the valve will be closed and will remain in a closed position until the temperature rises again to the chosen value.

The method according to the invention has the advantage of being able to be performed on existing plant without the need to make any major modification to the plant. The only modification that will typically be necessary is the installation of the necessary equipment or plant for supplying the liquefied atmospheric gas (or solidified atmospheric gas).

BRIEF DESCRIPTION OF THE DRAWING

The method and apparatus according to the invention will be further described by way of example with reference to the accompanying drawing, of which.

DESCRIPTION OF THE PREFERRED EMBODIMENTS

Figure 1:
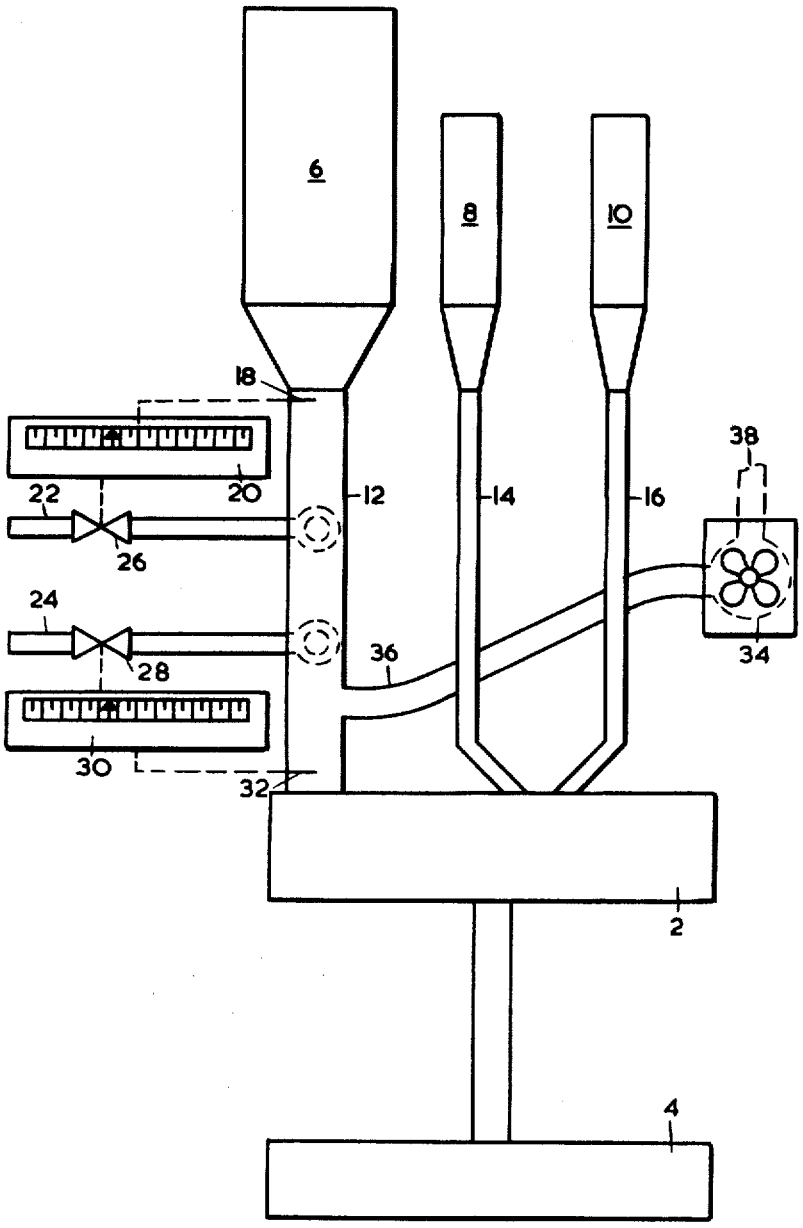
FIG. 1 is a schematic drawing illustrating a plant for making moulds.

Referring to FIG. 1 of the drawings, a plant for making moulds (or parts of moulds) has a mixer 2 adapted to mix sand, resin binder and catalyst at the ambient temperature and to supply the resulting free-flowing mixture to a moulding station 4, in which moulds are formed. The moulding station may be adapted to perform the hot box or cold box process, and the resin binder-catalyst system may be chosen accordingly. As the mixer 2 and moulding station 4 are of entirely conventional design and perform their normal functions they will not be described further.

The mixer 2 has associated therewith three hoppers 6, 8 and 10. The hopper 6 is intended for sand and is much larger than the hoppers 8 and 10, which are intended for binder and catalyst respectively, as the resulting moulds will contain from 80% to 95% by weight of sand. The hopper 6 has at its bottom a passage 12 which leads into the mixer 2. Analogously, the hoppers 8 and 10 have passages 14 and 16 respectively which lead into the mixer 2.

Figure 2A:
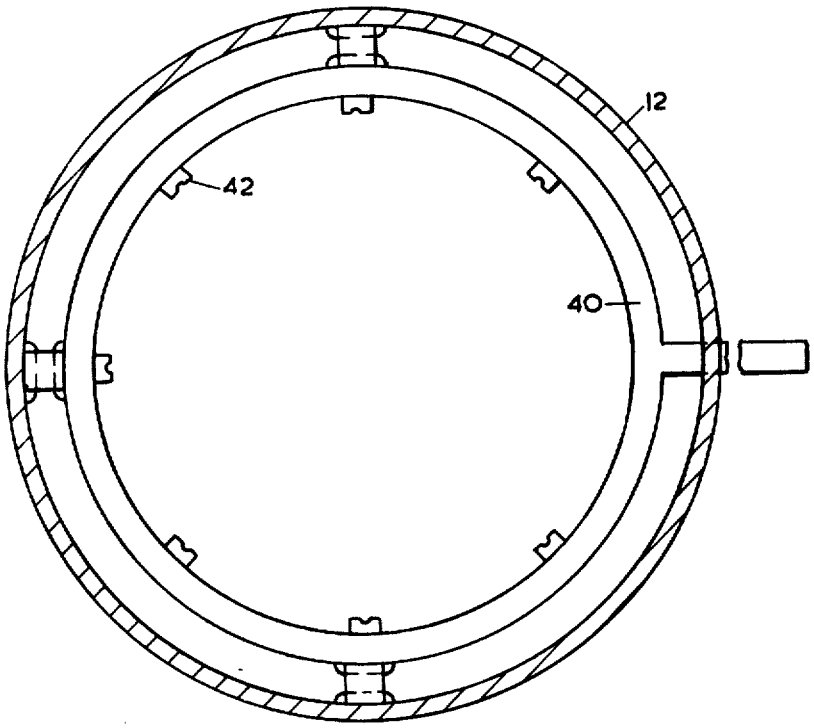
FIGS. 2A and 2B are schematic drawings illustrating liquid nitrogen spraying means associated with the plant shown in FIG. 1.
Figure 2B:
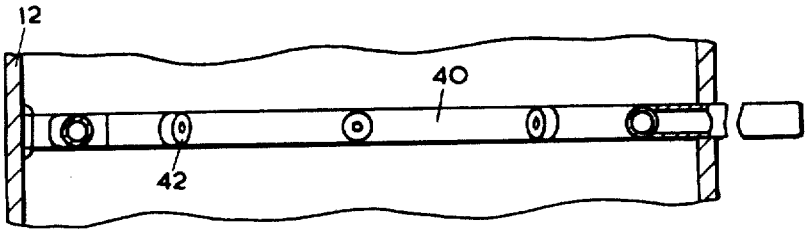

Main liquid nitrogen supply pipes 22 and 24 communicate with a source of liquid nitrogen (the source not being shown). The pipes terminate in annular spray pipes 40 which are horizontally disposed within the passage 12. An annular spray pipe 40 is shown in FIGS. 2A and 2B. It has spray jets 42 directed radially inwards.

In the pipe 22 is a solenoid valve 26. It is operatively associated with a temperature sensor 18 located in the passage 12 just below the outlet of the hopper 6. In operation, the temperature sensor 18 generates an electrical signal which is relayed to a temperature controller 20 programmed so as to open the valve 26 when the sensed temperature of sand falling under gravity from the hopper 6 into the passage is above a chosen value. If desired, the arrangement may be such that the extent to which the valve is opened varies with the sensed temperature. Thus, if the sensed temperature is only a degree or two Centigrade (or Celsius) above the chosen temperature, the valve 26 may open only to a small extent, but if the excess temperature is greater the valve 26 may be fully opened. The dimensions of the valve 26 and the programming of the controller 20 may be such as to avoid the possibility of reducing the temperature of the sand to an undesirably low value. The temperature controller 20 may be programmed such that valve 26 opens upon sensor 18 detecting a temperature in passage 12 a few degrees Centigrade below the temperature at which the resin begins to cure.

In the pipe 24 is a solenoid valve 28. The solenoid valve 28 is operatively associated with a temperature sensor 32 located near the bottom of the passage 12. In operation, the temperature sensor senses the temperature of the sand falling under gravity from the hopper 6 through the passage 12. Depending on the temperature sensed by the sensor 18, the sand may by the time it comes into contact with the sensor 32 have been cooled by contact with liquid nitrogen. The sensor 32 is able to sense whether there has been an adequate reduction in temperature caused by the sand being contacted by sprays of liquid nitrogen (and cold nitrogen vapour formed as a result of the liquid nitrogen evaporating). If the temperature sensed by the sensor 32 is above a chosen value, the electrical signal generated by the sensor 32 and relayed to a controller 30 analogous to the controller 20, the valve 28 will be opened by virtue of a command signal generated by the controller 30 (which is appropriately programmed) and liquid nitrogen will flow through the pipe 24 into the annular spray pipe 40 connected thereto. Thus further liquid nitrogen will be sprayed onto the sand and a further reduction in the temperature of the sand will result from this. The programming of the controller 30 may be such that the valve 28 will be only partially opened if the temperature sensed by the sensor is just above the chosen temperature, but be (more) fully opened if there is a greater difference in temperature between the temperature sensed by the sensor 32 and the chosen temperature.

Upstream (ie. above) the sensor 32 but below the spray pipe 40 a pipe 36 communicates with the interior of the passage 12. The pipe 36 terminates in a fan 34 having an outlet 38. By operation of the fan 34 nitrogen vapour is extracted from the passage 12.

In operation of the plant shown in FIG. 1 sand at or close to a chosen temperature is delivered to the mixer with resin binder and catalyst.

Figure 3:
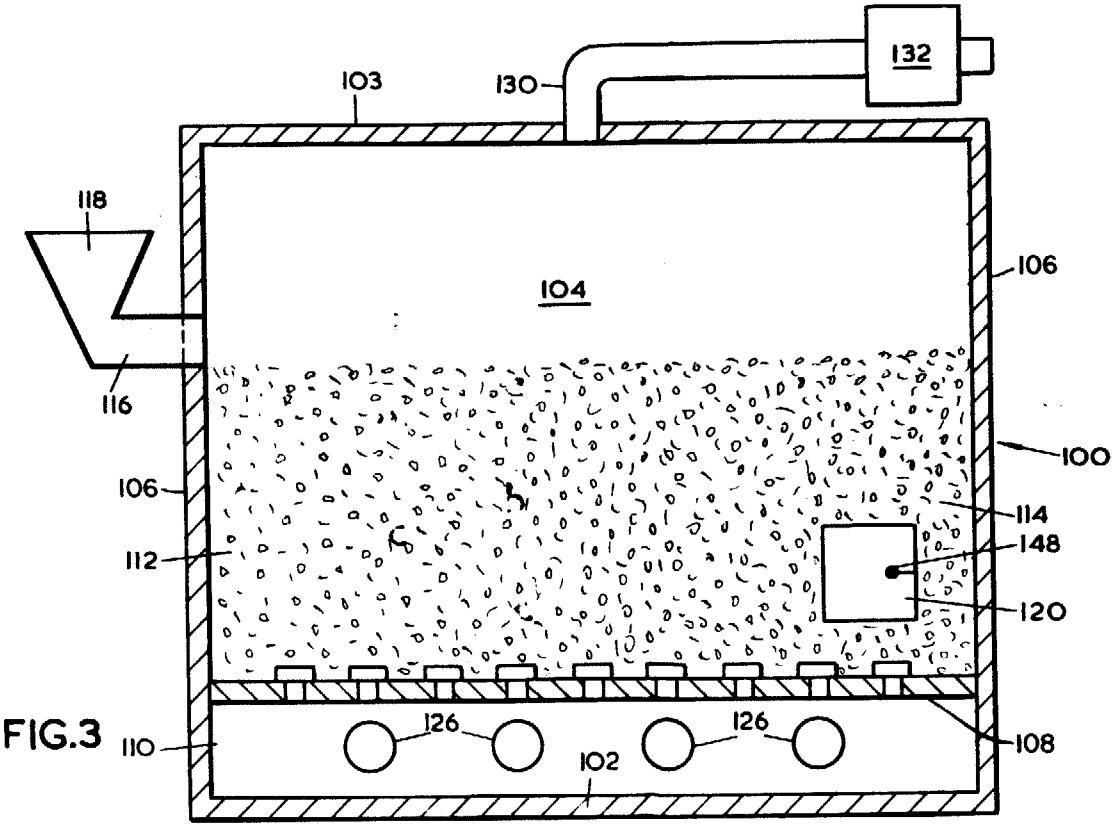
FIG. 3 is a schematic drawing illustrating a diagrammatic view of a fluidised bed sand cooler.
Figure 4:
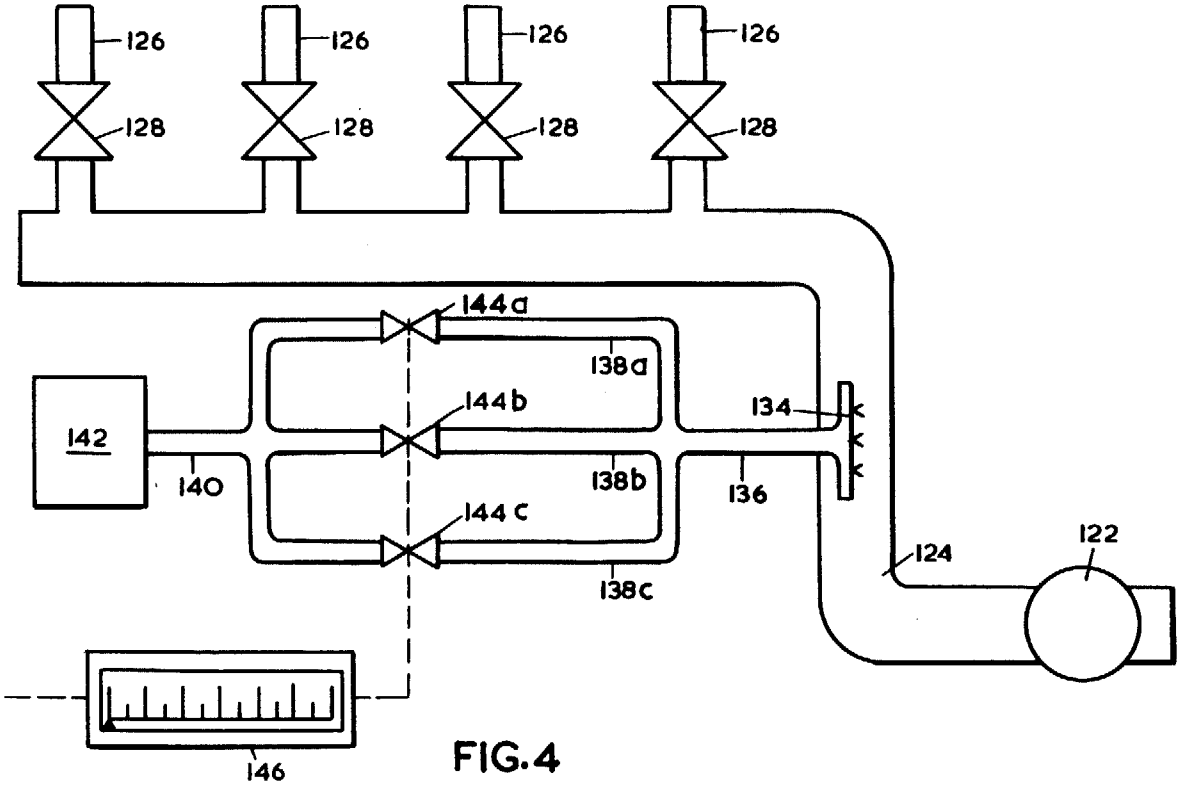
FIG. 4 is a schematic diagram illustrating means for supplying fluidising air and cold nitrogen to the cooler shown in FIG. 3.

Referring now to FIGS. 3 and 4 of the accompanying drawings, the cooler illustrated in FIG. 3 has a housing 100. The housing 100 has a floor 102 and a roof 103, a pair of longer parallel sides 104 (only one shown in FIG. 3) which shall herein be referred to as the front and back of the cooler, and a pair of shorter parallel sides 106. Spaced above the floor 102 and extending parallel thereto is a grid 108 which forms the roof of a plenum chamber 110 within the housing 100, and the floor of a cooling chamber 112 in which a fluidised bed 114 of grains of sand is able to be established in operation of the cooler.

The cooling chamber 112 has in one of the sides 106 of the housing 100 an inlet 116 in communication with a hopper 118 into which sand for cooling may be loaded. Located near to the other side 106 of the housing in the back 104 thereof, a relatively small distance above the grid 108 is an outlet 120 for sand. This outlet may if desired communicate with another hopper in which cooled sand may be collected.

Dry air for fluidising the sand is able to be supplied from a blower 122 (see FIG. 4) through an air main 124 and conduits 126 into the plenum chamber 110 in which the conduits 126 terminate. In each conduit 126 there is a balancing valve 128 operable to ensure that the fluidising air is equally distributed in use of the cooler. The pressure and flow rate of the air may be chosen so as to ensure that the sand can be adequately fluidised.

Referring again to FIG. 3, the housing 100 has an outlet 130 for the air. The outlet 130 is disposed in the roof 130. The outlet 130 communicates with a filter 132 of conventional design.

With reference to FIG. 4, a spray head 134 is situated in the air main 124 downstream of the blower 122. The spray head 134 forms the outlet of a thermally insulated pipe 136 whose inlet is served by three thermally-insulated conduits 138(*a*), 138(*b*), and 138(*c*), all of which are placed in communication with a source 142 of liquid nitrogen by a thermally-insulated pipeline 140. Automatic valves 144(*a*), 144(*b*) and 144(*c*), typically solenoid actuated, are located in the conduits 138(*a*), 138(*b*), and 138(*c*) respectively. Whether these valves are in open or closed positions is determined by a temperature controller-cum-indicator 146 with which the valves 144 are associated. The temperature controller-cum-indicator 146 is in turn operatively associated with a temperature sensor 148 located in the outlet 120 (see FIG. 3).

In operation of the cooler shown in FIGS. 3 and 4, sand which has been quarried is dried and then fed into the hopper 118. Typically the material for drying is composed of silica sand, or other kinds of sand, in the proportion of 90 to 95% by weight, substantially all the remainder being moisture. Typically, the moisture content of the dried sand is less than 0.1% by weight.

In order to commence operation of fluidised bed 114, blower 122 is started so as to supply fluidising air at ambient temperature through the main 124 (FIG. 4) and the conduits 126 to the plenum chamber 110 and dried sand is allowed to fall under gravity from the hopper 118 into the cooling chamber 112. The sand is continually passed into the chamber 112 wherein the sand is cooled and fluidised before leaving through the outlet 120. The temperature of fluidised sand is sensed in the outlet 120 by the temperature sensor 148. This temperature governs whether or not liquid nitrogen is sprayed into the air main 124. The temperature controller-cum-indicator 146 is programmed so as to translate electrical signals from the sensor 148 indicative of temperature into operating instructions for the automatic valves 144. Electronic circuits for effecting this translation are well known in the art.

The controller-cum-indicator 146 may typically be 'programmed' as follows. When the temperature is below a predetermined temperature, say 24° C., the valves 144(*a*), 144(*b*) and 144(*c*) are all in closed positions. Should the sensed temperature rise to 24° C., the valve 144(*a*) opens. Liquid nitrogen at a temperature of −196° C. is thus sprayed into the air main 124 at a chosen rate. On contact with the air the liquid nitrogen evaporates thus cooling the air. Thus the fluidising air is reduced in temperature. Typically, this will cause the temperature of the sand to fall again to below 24° C. If after a chosen time the temperature has not fallen to below 24° C., the programmer-cum-controller 146 will generate a signal to open valve 144(*b*) so as to double the rate at which liquid nitrogen enters the main 124 and thereby further decrease the temperature of the fluidising air. If after a further interval of time the temperature has not fallen to below 24° C., the programmer-cum-controller 146 will generate a signal to open valve 144(*c*) so as to increase again the rate at which liquid nitrogen enters the main 124 and thereby further decrease the temperature of the fluidising air. When the temperature falls below 24° C. all the valves revert to their closed positions.

According to the sensitivity of the temperature sensor and the response time of the programmer-cum-indicator 146, the temperature at which the valve 144(*a*) is set to open may be, say, 2° C. below the maximum sand temperature that can be tolerated.

The cooled sand leaves the chamber 112 through the outlet 120. It may then be passed into a large storage hopper to await collection and transport to foundries.

The fluidising air leaves the chamber 112 through the outlet 130. Some grains of sand are carried out of the chamber 112 in the air. These are removed from the air by the filter 132 and returned to the hopper 118.

I claim:

1. In a method of making moulds which comprises the steps of supplying sand, a resin binder and a catalyst to a mixing device to form a free flowing mixture of sand, resin binder and catalyst;

supplying said mixture to a mould station without substantial curing of said resin binder; and forming moulds in said mould station; the improvement comprising:

feeding sand through a separate conduit to said mixing device;

sensing the temperature of said sand in said conduit;

introducing a flow of cryogenic liquid into said conduit to contact said sand and reduce the temperature thereof as it is being fed upon sensing said temperature above a predetermined value only a few degrees centigrade below that at which curing of the resin binder takes place in the mixing device; and controlling the flow of said cryogenic liquid in response to said sensed temperature so that the temperature of said sand is reduced to said predetermined value upon being fed into said mixing device.

2. The method defined in claim 1 wherein the step of introducing said cryogenic liquid into said conduit comprises spraying said liquid through a plurality of outlets into said conduit.

3. The method defined in claim 1 wherein the step of controlling said flow of cryogenic liquid comprises interrupting said flow upon sensing the temperature of the sand in said conduit at a value below said predetermined temperature and between 20°-30° C.

4. The method defined in claim 1 wherein said cryogenic liquid is selected from the group consisting of liquid nitrogen, liquid carbon dioxide or liquid argon.

5. The method defined in claim 1 wherein the step of forming moulds comprises making moulds by a hot-box process.

6. The method defined in claim 1 wherein the step of forming moulds comprises making moulds by a cold-box process.

7. Apparatus for making moulds comprising a conduit; means for feeding sand through said conduit; a mixing device adapted to receive sand fed through said conduit; means for supplying resin binder and catalyst to said mixing device; means for sensing the temperature of said sand in said conduit; means for introducing a flow of cryogenic liquid into said conduit to contact and reduce the temperature of said sand as it is being fed therethrough upon sensing said sand temperature above a predetermined value only a few degrees centigrade below that at which curing of the resin binder takes place in the mixing device; means for controlling the flow of said cryogenic liquid in response to said sensed temperature such that said sand is received in said mixing device at said predetermined value whereby said mixing device is effective to form a free flowing mixture of said sand, resin binder and catalyst; means for forming moulds and means for supplying said free flowing mixture to said mould forming means.

8. Apparatus as defined in claim 7 wherein said means for controlling said flow of cryogenic liquid comprises a valve through which said liquid is passed into said conduit and programmable means coupled to said temperature sensing means for opening said valve only when said sensed temperature is above said predetermined value.

9. Apparatus as defined in claim 7 wherein said means for introducing cryogenic liquid into said conduit comprises an annular spray pipe disposed in said conduit and having a plurality of outlets through which said cryogenic liquid is sprayed into said conduit.

* * * * *